United States Patent [19]

Miller

[11] 4,362,777

[45] Dec. 7, 1982

[54] NONWOVEN SHEETS OF FILAMENTS OF ANISOTROPIC MELT-FORMING POLYMERS AND METHOD THEREOF

[75] Inventor: Philip E. Miller, Wilmington, Del.

[73] Assignee: E. I. Du Pont de Nemours and Company, Wilmington, Del.

[21] Appl. No.: 340,638

[22] Filed: Jan. 19, 1982

[51] Int. Cl.[3] ..... D03D 3/00

[52] U.S. Cl. ..... 428/224; 156/181; 156/308.2; 428/288; 428/296; 428/360; 428/395

[58] Field of Search ..... 156/181, 308.2; 428/288, 296, 360, 395, 224

[56] References Cited

U.S. PATENT DOCUMENTS

| | | |
|---|---|---|
| 3,160,605 | 12/1964 | Kantor et al. . |
| 3,276,944 | 10/1966 | Levy . |
| 4,032,607 | 6/1977 | Schulz . |
| 4,066,620 | 1/1978 | Kleinschuster et al. . |
| 4,183,895 | 1/1980 | Luise . |

FOREIGN PATENT DOCUMENTS

| | | |
|---|---|---|
| 53-103068 | 9/1978 | Japan . |

*Primary Examiner*—James J. Bell

[57] ABSTRACT

Strong dimensionally stable high-melting nonwoven fibrous sheets comprised of filaments from an optically anisotropic melt-forming polymer and self-bonded at a plurality of filament cross-over points, and a process for making such sheets.

10 Claims, No Drawings

NONWOVEN SHEETS OF FILAMENTS OF ANISOTROPIC MELT-FORMING POLYMERS AND METHOD THEREOF

BACKGROUND OF THE INVENTION

1. Field of the Invention

The present invention is concerned with high tensile strength, high-melting, dimensionally stable nonwoven sheets from filaments derived from anisotropic melt-forming polymers and to production of such sheets.

2. Description of the Prior Art

It is known to prepare self-bonded nonwoven sheets of synthetic organic filaments in a variety of ways. The sheets may be prepared from continuous filaments or staple fiber.

In the prior art, self-bonded sheets are made by depositing molecularly oriented filaments on a collecting surface with either random or directionalized fiber orientation. Filaments are then bonded together at the filament cross-over points by the application of heat and pressure for short periods of time and without use of adhesives or binders. Levy, U.S. Pat. No. 3,276,944, is typical of these processes. An alternate method is the use of volatile solvents to activate bonding as in Mallonee et al., U.S. Pat. No. 3,516,900. Self-bonded sheets have an advantage over resin-bonded sheets because their properties tend to approach the properties of the filaments while resin bonded sheets tend to depend on the properties of the resin, which are usually much poorer than those of the fiber. The strength of these prior art self-bonded sheets is fully developed at the completion of the hot-pressing or solvent bonding step. These prior art bonding processes are unsuitable for developing the maximum sheet strength capabilities of sheets consisting essentially of heat-strengthened filaments from optically anisotropic polymer melts.

Japanese Patent Application Publication No. 103,068/1978 discloses fibrous structures from optically anisotropic melt polymers. The structures are formed by extruding a melt containing a gas or other blowing agent through a slit as in film casting with a draft ratio of preferably 3:1 to 100:1, thereby forming, upon release of pressure, a fractured film with innumerable discontinuous cracks in the machine direction. The resulting sheet may contain fibrous elements with film-like cross-sections interconnected by larger areas of film and is different from the self-bonded sheets of this invention in that there are no bonded filament cross-over points. The tensile properties of the sheet are highly directionalized, being best in the machine direction and poor in the cross-machine direction. The Japanese reference discloses that the sheet may be strengthened by heat treatment.

SUMMARY OF THE INVENTION

The product of the invention is a strong, dimensionally stable, high-melting, nonwoven fibrous sheet comprised of filaments from an optically anisotropic melt-forming polymer, the filaments being disposed in multiple directions within the plane of the sheet and being self-bonded at a plurality of cross-over points, the filaments between bond points being substantially undeformed, the fibrous sheet having a tensile strength in at least one direction of at least 1.0 N/cm//g/m$^2$, preferably at least 2.0 N/cm//g/m$^2$, and having a tensile strength in a direction perpendicular to that direction which is at least 25 percent, preferably at least 50 percent, of the strength in that direction.

The process of the invention comprises: (1) melt spinning a plurality of filaments from an optically anisotropic melt-forming polymer, (2) depositing the filaments on a collecting surface in the form of a loose web within which the filaments are substantially separated except for contact at cross-over points and are disposed in multiple directions within the plane of the web; (3) hot-pressing the web at a pressure, temperature and for a time sufficient to fuse the filaments at a plurality of cross-over points while avoiding substantial deformation of the fiber between cross-over points; (4) removing the pressure from the hot-pressed web, and heating it in a purged inert atmosphere at a temperature below the filament flow temperature, the temperature and exposure time being sufficient to increase tensile strength of the sheet by at least 25 percent, preferably by at least 50 percent.

DETAILED DESCRIPTION OF THE INVENTION

The present invention provides a bonded, heat-strengthened, dimensionally stable nonwoven sheet of filaments that are melt spun from optically anisotropic melt-forming polymers and a method for preparing the product. This sheet is particularly useful as a substrate in roofing materials because of its high modulus, strength, dimensional stability and high thermal resistance.

Techniques for melt-spinning and laying down nonwoven webs of synthetic polymeric filaments that are well separated from each other except for contact at filament cross-over points are well known and may be utilized in the process of the present invention. Such techniques are described in the patent literature, e.g., U.S. Pat. No. 3,338,992. Separation of filaments can be accomplished by electrostatic charging by use of the apparatus of Disabato and Owens (U.S. Pat. No. 3,163,753) or Kinney (U.S. Pat. No. 4,233,014) or by any of a variety of other techniques. As will be apparent to those skilled in the art, the separated filaments should be deposited on the collecting support in such a way that a sheet of uniform basis weight is provided. Filament directionality within the plane of the sheet should be appropriate for the intended end-use.

The filaments used in the process to prepare the webs of the invention are melt spun from optically anisotropic melt-forming polymers. Large groupings of such polymers are described in Japanese Patent Publication No. 103,068/1978 and U.S. Pat. No. 4,183,895 mentioned above and in many other U.S. patents, e.g., U.S. Pat. Nos. 4,118,372, 4,048,148, 4,256,624, 4,161,470, 4,219,461, 4,232,144, 4,181,792 and 4,245,084. These include aromatic or cycloaliphatic polyesters, polythiolesters, aromatic polyazomethines, and the like. While fibers in general which are spun from optically anisotropic melt-forming polymers are useful, preferred compositions are those which can be strengthened to 10 dN/tex, preferably 20 dN/tex and most preferably 30 dN/tex. These include poly(chloro-1,4-phenylene terephthalate/2,6-naphthoate) (70/30), poly-(chloro-1,4-phenylene terephthalate/2,6-naphthalate) (70/30), poly(1-oxy-4-benzoyl/2-oxy-6-naphthoyl), poly(nitrilo-2-methyl-1,4-phenylenenitrilomethylidyne-1,4-phenylenemethylidyne), poly(1-oxy-4-benzoyl/1,4-phenylene isophthalate) and the like.

The polymers are melt-spun as described in the above references. It is not essential that spinning and depositing as a web on the collecting surface be carried out as a single operation although this is much preferred for continuous filaments. Alternatively, the filaments in the web prior to the hot-pressing step may be in the form of staple fibers deposited by known processes on a support as, e.g., a moving belt. In this embodiment, the melt-spun filaments are converted to staple fiber before being deposited as a loose web and hot pressed. A single fiber composition or blends of two or more anisotropic melt-forming fibers may be used.

Sheet basis weight can be as low as 15 g/m$^2$ or less; however, for greater rigidity and particularly where the sheets are to be impregnated with resins for composite materials, higher basis weights, e.g., 300 g/m$^2$, are useful. For thicker structures, multiple layers can be laminated. In general the sheet basis weight will be in the range of from 15 to 300 g/m$^2$, preferably between 15 to 100 g/m$^2$.

Filament directionality governs the relative tensile strengths in the plane of the sheet. Useful sheets have a tensile strength in at least one direction that is at least 1.0 N/cm//g/m$^2$, preferably at least 2.0 N/cm//g/m$^2$, and a tensile strength in a direction perpendicular to that direction that is at least 25 percent, preferably at least 50 percent of the tensile strength in that direction. The filament directionality may be varied to provide sheets which are essentially random with nearly equal tensile strengths in all directions within the plane of the sheet.

Once the assembly of filaments has been laid down in the form of a loose web, it is hot-pressed prior to heat-strengthening. This may be accomplished, for example, by hot-pressing the web between platens or by passing the web through the nip of hot calendar rolls. Sheets may be preheated by a hot gas just prior to pressing between rolls or the pressure could be provided by the hot gas itself by having a different pressure on each side of the sheet. If desired, the pressure may be applied to designated portions of the sheet surface, provided the tensile strength is in the range stated above, in which case bonding will effectively take place only in those areas. As will be well understood by those skilled in the art, there is a time-temperature-pressure relationship involved, that is, bonding during hot-pressing can be achieved at lower temperatures and higher pressures and vice versa. In any case, the condition during hot-pressing should be such that bonding occurs at filament crossover points without causing the sheet to fuse and preferably without undue deformation of the filaments, i.e., filaments should have uniform cross-sections along lengths between bond sites and should maintain their integrity (original form and dimensions) between bond sites. Temperatures during hot-pressing should approximate or exceed the fiber stick temperature. This is conveniently determined by the method of R. G. Beaman and F. B. Cramer, J.Poly.Sci. V.21, p. 228 (1956) at a fiber tension in grams equal to 32% of the fiber tex. Temperatures during hot-pressing should approximate or exceed the fiber stick temperature in order to achieve adequate bonding but should not be so great as the melt the filaments and cause gross polymer flow. It is preferred to maintain the temperature below the polymer flow temperature during this phase of the process and from 10°–40° C. above the fiber stick temperature. Pressures of at least 7 kPa gauge, preferably at least 70 kPa gauge, are required for adequate bonding. More preferably, pressures from 140–700 kPa gauge are employed in order to achieve optimum results. These conditions of pressure and temperature will normally be maintained for between one second and ten minutes, i.e., sufficient time to bring the fibers to the temperature of the platens, rolls or hot gas. Conditions for hot-pressing should not be so severe that fiber identity at cross-over points is lost.

Following hot-pressing, the sheet is heat-strengthened. This involves removing the pressure used to hot-press the web and heating the sheet in an atmosphere inert to the fiber, e.g., in nitrogen or a nonoxidizing gas such as carbon dioxide or a hydrocarbon mix, or under vacuum, at elevated temperatures of at least 100° C., preferably 200° C. to 400° C., but below the filament flow point for a time sufficient to increase the tensile strength of the bonded sheet 25 to 50 percent or more. Frequently the optimum temperature for heat-strengthening and the period of heat-treatment will depend on the particular polymeric filaments that comprise the sheet. The heat treatment process for strengthening filaments from anisotropic melt-forming polymers is now well known in the art. This is taught in U.S. Pat. No. 4,183,895 and in much patent literature. Upon heating the hot-pressed sheet, one obtains strengthened filaments, and it is believed that the bonds formed on hot-pressing also are strengthened with the result that high strength sheets are formed. Such sheets also have desirable high elongation at maximum load during testing usually greater than 2.5%, preferably greater than 4.5%.

Filaments that are melt-spun from anisotropic melt-forming polymer having a lower flow temperature in the as-spun condition than in the heat-strengthened condition. Thus bonding of the as-spun filaments at cross-over points during the hot-pressing step occurs more readily and at a lower temperature and pressure than is possible with the heat-treated fiber.

The heat-strengthened sheets of this invention do not melt below 200° C. The preferred sheets do not melt below 250° C.

The outstanding properties of the products of this invention make them useful as substrates in roofing material where because of their thermal and dimensional stability they are able to withstand extreme temperature cycles during use. These same properties make them useful in geotextile applications.

DEFINITIONS

The term "dimensionally stable" means there is less than 2%, preferably less than 1% thermal shrinkage of the sheet per 100° C. measured within the range of 0° C. to 250° C.

The term "inert to the fiber" means no deleterious reactions such as oxidation occur to seriously limit strength attainable.

The phrase "substantially separated" means adjoining filaments touch only at cross-over points and not for long portions of their length.

The term "flow temperature" is defined in U.S. Pat. No. 4,183,895, Col. 11, lines 6–10 for both polymer and fiber.

TEST METHODS

Tensile strength, modulus, and elongation of sheets were determined by ASTM method D1682—Cut Strip Test 1C. Nonwoven sheets were first conditioned at least 16 hours at 21° C. and 65% relative humidity and then tested at the same conditions. Several rectangular strips 2.54 cm × 15.2 cm were cut from each sheet to be tested. The strips were broken by means of a Instron Tensile Tester having jaws 5.1 cm wide faced with neoprene synthetic rubber. Initial gauge length was 5.1 cm. The strain rate was a constant 50%/min. The elongation is the percent increase at maximum load based on original gauge length. Tensile strength and modulus are reported in Newtons (N)/cm divided by the average sheet basis weight in g/m$^2$ to give N/cm//g/m$^2$. The reported values are the average of at least three breaks. The gauge length (5.1 cm) is believed to be sufficiently long to be a measure of both bond and filament strength.

Tensile strength, modulus, and elongation of filaments and multi-filament yarns were determined as in Morgan, U.S. Pat. No. 3,827,998. The filaments and yarns were conditioned for 16 hours at 21° C. and 65% R.H. before testing. Tensile strength and modulus for single filaments and for multifilament yarns are reported in dN/tex.

Tongue tear of sheets was measured by ASTM method D2261 on 5.1 cm wide × 5.7 cm long rectangular specimens conditioned for at least 16 hours at 21° C. and 65% R.H. The initial gauge length was 2.54 cm. A 2.54 cm long slit was cut lengthwise in the specimen starting in the center of the shorter edge. The peak load required to continue a tear along the cut was measured. The peak load was determined on at least three specimens at a constant extension rate of 1200%/minute in an Instron Tensile Tester equipped with neoprene-faced 5.1 cm wide jaws. The average peak load was reported in Newtows (N) and divided by the average basis weight to give N//g/m$^2$.

Basis weight is the average of the weights of specimens in a given test, and is reported in g/m$^2$.

Pressure. All pressures reported for the hot-pressing of sheets are given in kPa gauge.

EXAMPLE 1

Nonwoven sheet from a polyester derived from phenylhydroquinone (PHQ) Diacetate, resorcinol (RQ) diacetate, and terephthalic acid (T)

A polyester having the compositon PHQ/RQ/T (47.5/2.5/50), the parenthetical expression representing mole percent of the components in the polymer, was prepared from phenylhydroquinone (PHQ) diacetate, resorcinol (RQ) diacetate, and terephthalic acid (T) using the procedure of Payet, U.S. Pat. No. 4,159,365. The polymer formed an optically anisotropic melt. A 34-filament yarn (0.5 tex/filament) having an as-spun tenacity of 4.8 dN/tex, break elongation 1.4% and initial modulus 388 dn/tex was melt spun at 357° C. The melt-spun yarn was triboelectrically charged after it issued from the spinneret by passing downward in rubbing contact over 3-successive rotating cylinders having surfaces composed of rubber. The charged continuous filaments passed from the third rotating cylinder around a forwarding roll to an air jet which served to forward the yarn downward to a collecting surface consisting of an electrically grounded wire screen. A piece of glass fiber sheet (0.3 m × 0.3 m square) coated with polytetrafluoroethylene was placed on the screen to collect samples. The spinning, charging, and collecting arrangement was similar to that disclosed in Kinney U.S. Pat. No. 3,338,992, FIG. 2. The filaments were well separated upon arrival at the collecting surface and were deposited uniformly in random directions on the collecting surface. The uniformity of the collected web was further improved by moving the collecting surface to cause the depositing swath to traverse the surface at a speed much slower than the forwarding speed of the filaments. The traversing motion was repeated to provide a layer of overlapping swaths in one dimension of the collecting surface. After completion of a layer a second traversing motion provided another layer with swaths perpendicular to those in the first layer. Depositing in layers was continued to provide the basis weight indicated in Table 1.

The collected loose web on the coated glass fiber sheet was sprayed with a 0.5% solution of potassium iodide in 50/50 vol % water/ethanol, dried, then covered by a second coated glass fiber sheet (0.3 m × 0.3 m square) and the edges were trimmed. The resulting sandwich was placed between the hot platens (280° C.) of a hydraulic press and a pressure of 172 kPa was applied for 6 minutes. The resulting web was removed from the press and then heat-treated on a wire screen support in an oven in a nitrogen-purged atmosphere in the absence of mechanical pressure according to the following schedule of exposure times and temperatures:

Room temperature to 200° C., 2 hours
200° C. to 302° C., 7 hours
302° C., 6.7 hours.

Properties of the heat-treated nonwoven sheets are shown in Table 1. Three samples were cut from the sheet in each of two directions mutually perpendicular to one another. In the table these directions are labelled X and Y. Microscopic examinations showed that the heat-treated nonwoven web was bonded at cross-over points, but between cross-over points the filaments retained their identities. Filaments could be removed from the edge of the sheet. Average tensile properties for the removed filaments (3 breaks, 2.54 cm gauge length) are shown in Table 1.

Additional melt-spun yarn was heat-treated in a nitrogen-purged atmosphere using the same conditions as for the nonwoven sheet including use of potassium iodide. Properties of the yarn as-spun and after heat-treatment are shown Table 1.

In Table 1 the sheet tensile strengths in the X and Y directions are both outstanding, being well above 1.0 N/cm//g/cm$^2$. The filaments taken from the edge of the sheet before and after heat-strengthening showed a great increase in tenacity (440% increase) during the sheet heat-treatment. The tensile increase is similar to that obtained in the independently treated yarns. The data in Table 1 show that heat-strengthening can be accomplished even in a bonded sheet and that bonding does not deleteriously affect the fiber tensile properties.

TABLE 1

PROPERTIES OF NONWOVEN SHEETS, FILAMENTS AND YARN MADE FROM PHQ/RQ/T (47.5/2.5/50)

| Sheet Properties: | X Direction | Y Direction |
|---|---|---|
| Basis weight, g/m$^2$ = 61 | — | — |
| Tensile Strength, N/cm//g/m$^2$ | 1.71 | 1.24 |
| Modulus, N/cm//g/m$^2$ | 65.8 | 66.8 |
| Elongation at Maximum Load, % | 3.0 | 2.0 |
| Tongue Tear, N//g/m$^2$ | 0.28 | — |

Hot-pressed

TABLE 1-continued

PROPERTIES OF NONWOVEN SHEETS, FILAMENTS AND YARN MADE FROM PHQ/RQ/T (47.5/2.5/50)

| Filaments from Sheet: | Hot-pressed only | and Heat-strengthened |
|---|---|---|
| Tenacity, dN/tex | 3.7 | 20 |
| Elongation at break, % | 2.1 | 6.4 |
| Initial Modulus, dN/tex | 246. | 317 |
| **Yarns Separately Treated:** | **As-spun*** | **Heat-treated**** |
| Tenacity, dN/tex | 4.8 | 27.6 |
| Elongation at break, % | 1.4 | 3.7 |
| Initial Modulus, dN/tex | 388. | 623 |

*Fiber stick temperature was 255 to 260° C. and fiber flow temperature was 351° C.
**Tested with 2.7 turns/cm Z twist.

EXAMPLES 2–4

Nonwoven sheets from polyester derived from Chlorohydroquinone (CHQ) diacetate, resorcinol (RQ) diacetate, terephthalic acid (T), and 6-hydroxy-2-naphthoic acid (HNA) acetate A polyester having the composition CHQ/RQ/T/HNA (35/10/45/10) was prepared by melt polymerization of chlorohydroquinone (CHQ) diacetate, resorcinol (RQ) diacetate, terephthalic acid (T), and 6-acetoxy-2-naphthoic acid (HNA). The polymer formed an optically anisotropic melt. A 34-filament yarn was melt-spun and passed directly to the triboelectric charging unit and air jet forwarding unit described in Example 1. A sheet was collected as in Example 1. Samples of the loose web were then hot-pressed as in Example 1 by use of the three different sets of conditions shown in Table 2. These sheets were then heat-treatd in a nitrogen-purged oven as in Example 1 except that only the sheet of Example 2 was sprayed with potassium iodide solution. The maximum heat-treating temperatures are shown in Table 2. Tensile properties exhibited by the sheets are recorded in Table 2.

Satisfactory sheets with very high tensile properties were made as shown by the data in Table 2. The table also shows that satisfactory sheets may be obtained by use of a range of temperatures and pressures in the hot-pressing step. The fibers prepared from the polymer CHQ/RQ/T/HNA described in the example have desirably high maximum load elongation (over 4.5%), providing a sheet with superior toughness and good tongue tear strength.

TABLE 2

PROPERTIES OF NONWOVEN SHEETS PREPARED FROM CHQ/RQ/T/HNA (35/10/45/10)

| | Ex 2 | Ex 3 | Ex 4 |
|---|---|---|---|
| Melt Spinning Temp., °C. | 309 | 323* | 309 |
| Hot-pressing Temp., °C. | 200 | 140 | 160 |
| Pressure, kPa | 172 | 345 | 97 |
| Time, minutes | 4 | 4 | 4 |
| Heat-treatment, Max. Temp., °C. | 302 | 304 | 280 |
| Sheet Properties: | | | |
| Tensile strength, N/cm//g/m$^2$ | 3.29 | 3.14 | 2.01 |
| Modulus, N/cm//g/m$^2$ | 42.8 | 58.2 | 61.1 |
| Elongation at Max. Load, % | 9.6 | 7.4 | 4.9 |

TABLE 2-continued

PROPERTIES OF NONWOVEN SHEETS PREPARED FROM CHQ/RQ/T/HNA (35/10/45/10)

| | Ex 2 | Ex 3 | Ex 4 |
|---|---|---|---|
| Basis Weight, g/m$^2$ | 132 | 44 | 72.5 |
| Tongue Tear, N//g/m$^2$ | — | 0.47 | 0.96 |

*Fiber stick temperature is about 130° C.

EXAMPLE 5

Sheets derived from CHQ/RQ/T/HNA prepared with and without the hot pressing step The polymer composition of Examples 2–4 was melt-spun at 308° C. and at 323° C. and deposited in each case as a web according to the method of Example 1. The web (sheet 5A, 0.3 m×0.3 m square) from fiber spun at 323° C. was consolidated by pressing at room temperature (25° C.) in the platen press for 4 minutes at 138 kPa pressure. The other web (sheet 5B) was pressed at 160° C. for the same period (4 minutes) and the same pressure (138 kPa). Both sheets were then heat-treated in a nitrogen-purged atmosphere by the schedule of Example 1 except that the maximum temperature was 291° C. and no potassium iodide solution was used. The properties of the two heat-treated samples are shown in Table 3. It is obvious from the data that the process utilizing the hot pressing step before heat-treatment in nitrogen provides a nonwoven web with much superior tensile and tear strength, and preferred higher elongation.

TABLE 3

PROPERTIES OF HEAT-TREATED NONWOVEN WEBS WITH AND WITHOUT THE HOT-PRESSING STEP

| | Sheet 5A | Sheet 5B |
|---|---|---|
| Pressing temperature, °C. | 25. | 160. |
| Basis weight, g/m$^2$ | 63.4 | 66.1 |
| Tensile strength, N/cm//g/m$^2$ | 0.45 | 2.91 |
| Tensile modulus, N/cm//g/m$^2$ | 43.6 | 56.0 |
| Elongation at Max. Load, % | 0.85 | 7.1 |

EXAMPLE 6

Sheets derived from CHQ/RQ/T/HNA prepared with and without the heat-treatment step The polymer composition of Examples 2–4 was melt-spun at 335° C. and deposited as a web as in Example 1. A sample of the web (0.3 m×0.3 m) was hot-pressed at 175° C. for 4 minutes at 172 kPa pressure. The resulting hot-pressed sheet was cut in half. One part (Sheet 6A) was subjected to tensile testing without the heat-strengthening step. The other part (Sheet 6B) was heat-treated in a nitrogen-purged atmosphere as in Example 5 except that the maximum temperature was 288° C. Table 4 shows the superior properties that are obtained by hot-pressing following by heat-strengthening.

TABLE 4

PROPERTIES OF NONWOVEN SHEET AFTER HOT-PRESSING AND AFTER HOT-PRESSING PLUS HEAT-TREATMENT

| Process | Sheet 6A* Hot-Pressing Only | Sheet 6B* Hot-Pressing plus Heat-Treatment |
|---|---|---|
| Basis weight, | | |

TABLE 4-continued

PROPERTIES OF NONWOVEN SHEET AFTER HOT-PRESSING AND AFTER HOT-PRESSING PLUS HEAT-TREATMENT

| Process | Sheet 6A* Hot-Pressing Only | Sheet 6B* Hot-Pressing plus Heat-Treatment |
|---|---|---|
| g/m$^2$ | 19 | 17 |
| Tensile Strength, N/cm//g/m$^2$ | 0.2 | 1.2 |
| Tensile Modulus, N/cm//g/m$^2$ | 33.4 | 80.5 |
| Elongation at Max. Load, % | 0.45 | 2.0 |

*Average properties of two sheets.

EXAMPLE 7

The effect of reversing process steps

This example shows that sheets made by hot-pressing and then heat-treating are superior to those made by the reverse sequence.

The polymer composition of Example 2–4 was melt-spun at 309° C. and deposited as a web as in Example 1. A sample (Sheet 7A) was hot-pressed at 190° C. for 4 minutes at 345 kPa pressure and then heat-treated as in Example 5 except that maximum heat-treating temperature was 290° C. Two additional samples (Sheets 7B and 7C) were first heat-treated in a nitrogen-purged atmosphere, as in Example 5, with a maximum temperature of 280° C. Then the two webs were hot-pressed at 270° C. and 300° C., respectively, at 172 kPa pressure for 4 minutes. The data of Table 5 show that heat-strengthening after hot-pressing produces a far superior product, the tensile strength of Sheet 7A being many times that of Sheet 7B. Sheet C was overbonded, the fibers in many places having melted to a film.

TABLE 5

EFFECT OF REVERSING THE PROCESS

| Sequence | Sheet 7A Hot-Pressing; Heat Strengthening | Sheet 7B Heat-Strengthening; Hot-Pressing at 270° C. | Sheet 7C Heat-Strengthening; Hot-Pressing at 300° C. |
|---|---|---|---|
| Basis weight, g/m$^2$ | 75 | 84 | 87 |
| Tensile strength, N/cm//g/m$^2$ | 2.9 | 0.058 | 0.56 |
| Tensile modulus, N/cm//g/m$^2$ | 58 | 9.01 | 31 |
| Elongation at Max. Load, % | 7.1 | 2.2 | 2.2 |

EXAMPLE 8

A nonwoven sheet made from polymer derived from p-Acetoxybenzoic acid (HBA), 6-acetoxy-2-naphthoic acid (HNA), hydroquinone diacetate (HQ) and isophthalic acid (I)

A polymer was prepared having the composition HBA/HNA/HQ/I (40/3/28.5/28.5). It formed an optically anisotropic melt. A multifilament yarn was melt-spun from a spinneret at 335°–339° C. and deposited as a nonwoven web by the method described in Example 1. Samples of the sheet were hot-pressed at 180° C., 200° C., and 220° C. at a pressure of 144 kPa for 4 minutes. After hot-pressing, the sheets were heat-strengthened in a nitrogen purged oven; the temperature rose slowly to 200° C., fell slowly to 60° C., then rose again to 286° C., all in nine hours and was held at 286° C. for 6.7 hours before cooling. Tensile properties of the resulting nonwoven sheets are given in Table 6 for both an X and a Y direction in the sheet (mutually perpendicular samples).

TABLE 6

PROPERTIES OF SHEETS FROM HBA/HNA/HQ/I

| Ex. No. | Hot-Pressing Temp., °C. | Basis Weight, g/m$^2$ X | Basis Weight, g/m$^2$ Y | Tensile Strength, N/cm//g/m$^2$ X | Tensile Strength, N/cm//g/m$^2$ Y | Tensile Modulus, N/cm//g/m$^2$ X | Tensile Modulus, N/cm//g/m$^2$ Y | Elongation at Max. Load, % X | Elongation at Max. Load, % Y |
|---|---|---|---|---|---|---|---|---|---|
| 8A | 180 | 25 | 23 | 1.55 | 1.84 | 66.1 | 69.8 | 3.1 | 3.2 |
| 8B | 200 | 25 | 25 | 1.77 | 1.80 | 68.8 | 60.8 | 3.2 | 3.5 |
| 8C | 220 | 28 | 37 | 1.68 | 1.98 | 62.5 | 63.4 | 3.3 | 3.8 |

I claim:

1. A strong dimensionally stable high-melting nonwoven sheet comprised of filaments from an optically anisotropic melt-forming polymer, the filaments being disposed in multiple directions within the plane of the sheet and being self-bonded at a plurality of cross-over points, the filaments between bond points being substantially undeformed, the fibrous sheet having a tensile strength in at least one direction of at least 1.0 N/cm//g/m$^2$ and having a tensile strength in a direction perpendicular to that direction which is at least 25% of the strength in that direction.

2. The product of claim 1 wherein said fibrous sheet has a tensile strength in at least one direction of at least 1.0 N/cm//g/m$^2$ and a tensile strength in a direction perpendicular to that direction which is at least 50% of the strength in that direction.

3. The product of claim 1 wherein said filaments are in the form of staple fiber.

4. The product of claim 1 wherein said fibrous sheet has a tensile strength in at least one direction of at least 2.0 N/cm//g/m$^2$.

5. The product of claim 1 wherein the polymer is a polyester.

6. The product of claim 1 wherein said fibrous sheet has an elongation at maximum load during testing of at least 2.5%.

7. The product of claim 1 wherein said fibrous sheet has an elongation at maximum load during testing of at least 4.5%.

8. A process for preparing strong dimensionally stable high-melting nonwoven fibrous sheets comprising:

(1) melt spinning a plurality of filaments from an optically anisotropic melt-forming polymer, (2) depositing the filaments on a collecting surface in the form of a loose web within which the filaments are substantially separated except for contact at cross-over points and are disposed in multiple directions within the plane of the web, (3) hot-pressing the web at a pressure, temperature and for a time sufficient to fuse the filaments at the cross-over points while avoiding substantial deformation of the filaments between cross-over points, and (4) removing the pressure from the hot-pressed web and heating it in a purged inert atmosphere at a temperature below the filament flow temperature and for a time sufficient to increase tensile strength of the sheet by at least 25%.

9. The process of claim 8 wherein the web is hot-pressed at a pressure of at least about 7 kPa gauge, a temperature above the fiber stick temperature and for a time less than about 10 minutes.

10. The process of claim 8 wherein the melt-spun filaments are converted to staple fiber before being deposited in the form of a loose web on the collecting surface.

* * * * *